United States Patent [19]

Lucassen

[11] Patent Number: 4,968,188

[45] Date of Patent: Nov. 6, 1990

[54] APPARATUS AND METHOD FOR UNIFORMLY SUPPLYING FIBER FLOCK IN A CHUTE FEED

[75] Inventor: Guenther Lucassen, Haltern, Fed. Rep. of Germany

[73] Assignee: Hergeth Hollingsworth GmbH, Duelmen, Fed. Rep. of Germany

[21] Appl. No.: 758,342

[22] Filed: Jul. 24, 1985

[51] Int. Cl.[5] ..... B65G 53/50

[52] U.S. Cl. ..... 406/70; 19/105; 222/630; 406/160; 406/171

[58] Field of Search ..... 19/105; 406/70, 157, 406/159–161, 163, 171; 222/630

[56] References Cited

U.S. PATENT DOCUMENTS

| | | | |
|---|---|---|---|
| 3,257,151 | 6/1966 | Sprackling | 406/163 |
| 3,580,644 | 5/1971 | Ballard | 406/171 X |
| 3,728,759 | 4/1973 | Hergeth | 406/28 X |
| 3,777,790 | 12/1973 | Rutten | 406/160 X |
| 4,136,911 | 1/1979 | Husges et al. | 406/70 |
| 4,154,485 | 5/1979 | Lytton et al. | 406/159 X |
| 4,394,790 | 7/1983 | Keller et al. | 406/171 X |
| 4,476,611 | 10/1984 | Keller et al. | 19/105 |
| 4,531,262 | 7/1985 | Reiche | 19/105 X |

*Primary Examiner*—Andres Kashnikow
*Attorney, Agent, or Firm*—Cort Flint

[57] ABSTRACT

Apparatus and method for supplying fiber in a chute feed (10) are disclosed including a pivotal air control deflection vane (B) pivoted at an entrance (46) of a reserve section (12). The inclination of the vane (B) may be adjusted, depending on airflow conditions and fiber type, to redirect the incoming horizontal flow (58) of fiber-laden air and deposit the fibers (F) in a column having a level surface (80). The transport air (72) exits the chute (32) of the reserve section through a grille (70). The level column of fibers provides feeding of a uniform weight of fibers across the entire width (W) of the chute for uniform feeding and opening the feed roll (34) and opening roll (39).

15 Claims, 2 Drawing Sheets

Fig. 2.
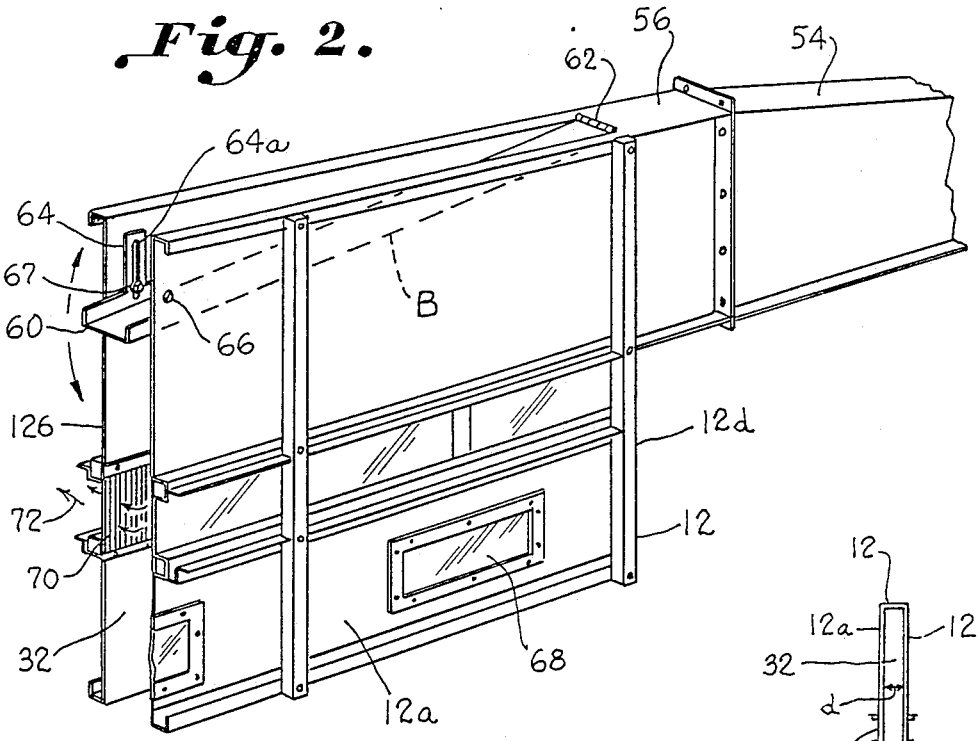
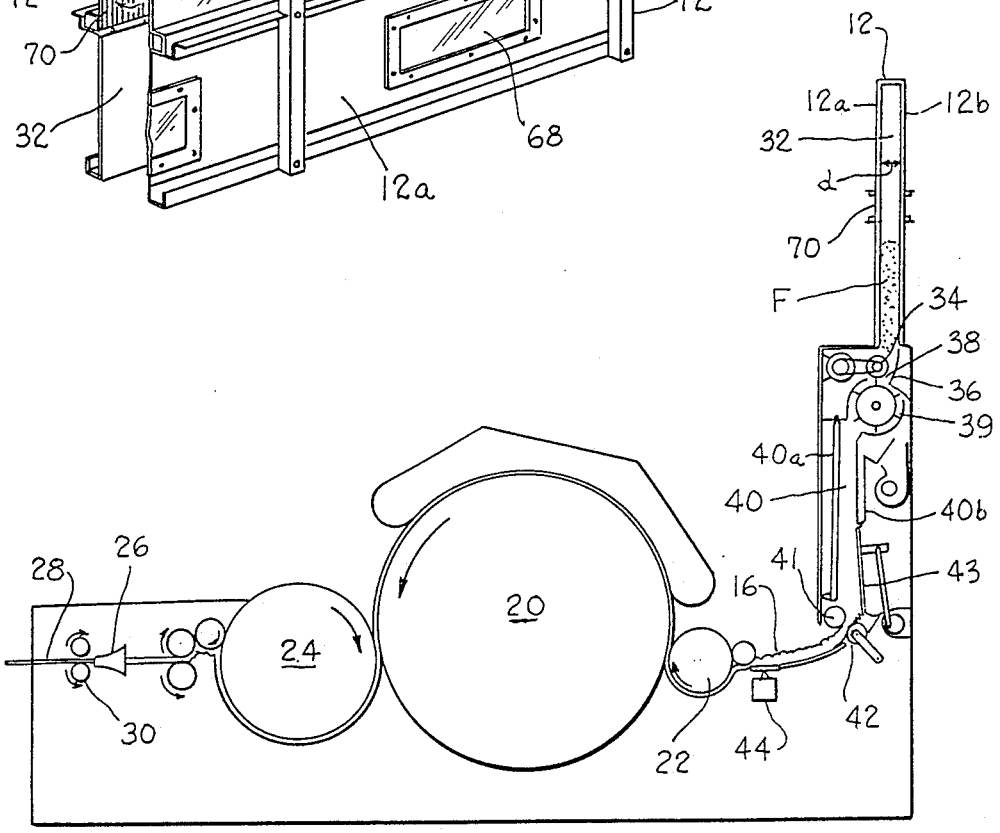
Fig. 1.

APPARATUS AND METHOD FOR UNIFORMLY SUPPLYING FIBER FLOCK IN A CHUTE FEED

BACKGROUND OF THE INVENTION

The invention relates to processing of textile fibers into a sliver, and particularly to apparatus and method for supplying the fibers uniformly in a nonturbulent manner for level distribution in the chute of a chute feeder of a carding machine and the like.

Conventionally, fibers, particularly cotton, are opened from a bale and cleaned on machines typically called blowroom machines which open and separate the fibers for trash removal. In the opening process, it is desirable to open the fiber masses and individualize the fibers as much as possible for cleaning and further processing. Fiber is delivered from the blowroom machines to a feeding system which feeds the carding machine. In the carding process, the fibers are straightened and aligned parallel prior to being drawn off in the form of a sliver.

A common card feeding system is a chute feed having vertical chutes in which fibers are accumulated and fed. In chute feeders, the fiber material is compressed and delivered to the carding machine in the form of a compacted fiber batt. The fiber flock is delivered to the entrance of the chute feed by a fiber-laden airflow. The fiber-laden air enters the entrance of the chute feeder and it is deposited in a reserve section of the chute above a top feed roll. The top feed roll feeds the fiber flock into an formation section of the chute where the fiber flock is compressed into the fiber batt. Bottom delivery rolls convey the fiber batt to the licker-in of the carding machine. By controlling the weight of the fiber batt, uniform sliver is produced by the carding machine.

The problem of supplying a fiber batt of a desired uniform weight is one to which considerable attention has been given in the art. For example, U.S. Pat. Nos. 4,476,611 and 4,387,486 disclose controlling the weight of a fiber batt by controlling the bottom feed roll speed and the speed of the compacting plate in response to a sensed weight output of the batt. Either directly or indirectly, the aforementioned parameters are controlled in response to the operation speed of the carding machine.

The conditions under which the fibers are delivered and deposited in the chute directly affect the performance of the chute feed in producing a fiber batt of uniform weight. In particular, the delivery of the fiber flock by airflow into the reserve section of the chute feed has typically been in a rather uncontrolled fashion resulting in non-level fiber distribution as pressure varied. Typically, a higher level of fibers is accumulated at the side of the chute feed remote from the entrance side due to the patterns flow paths of incoming transport air. Uneven distribution of fiber can occur across the entire width of the chute feed. The resulting batt of the fibers delivered at the outlet of the chute feed may have an uneven bulk density across its width. It has been found according to the present invention that a flat or level distribution of the fiber flock across the width of the reserve section results in uniform pressure imposed upon the fiber flock and thus a uniform feeding of flock by the top feed roll. The fibers are then delivered by the feed roll and accumulated evenly across the width of the chute of the formation section provides more accurate control over the uniformity of the weight and bulk density of the fiber batt delivered to the card. The end result is that the production of a more uniform sliver by the carding machine is carried out in an efficient manner.

Accordingly, an object of the present invention is to provide apparatus and method for uniformly supplying fiber flock to a chute feeder.

Still another object of the present invention is to provide an apparatus and method for providing a flat or level distribution of fiber flock in a chute of the reserve section of a chute feed so that the fiber is subjected to a uniform pressure across the chute for feeding.

Still another object of the present invention is to supply fiber flock to a chute feed in a nonturbulent manner resulting in a uniform and level distribution of the fiber across the chute of the chute feed reserve section.

Yet another object of the present invention is to provide an apparatus and method for supplying fiber flock to a chute feeder wherein the weight per unit length output of a fiber batt is more accurately controlled.

SUMMARY OF THE INVENTION

The above objectives are accomplished according to the present invention by providing an apparatus and method for supplying fiber to a chute feeder in a nonturbulent manner whereby fibers are distributed uniformly to form a level or flat substantially horizontal surface across the chute. The apparatus includes a divergent nozzle which delivers the fiber flock from a transport blower to an entrance end of the reserve section of a chute feed. An adjustable vane is pivotably carried at the entrance to the reserve chute at an inclination to the incoming fiber-laden air. The flow of the fiber-laden air expands in the divergent nozzle slowing the flow of fiber flock prior to passing to the reserve section. Upon striking the inclined vane extending across the width of the reserve section chute, the horizontal flow of fiber-laden air is redirected vertically downwardly into the shaft of the reserve section. The entire flow of fiber-laden air impinging along the entire length of the inclined vane is redirected depositing fiber flock at an even, substantially level and horizontal flock surface extending across the reserve section chute. The pressure of the transport air acts on the level surface of the fiber flock in the chute to compact it in a uniform manner. The fibers are compacted into a uniform mass and fed in that manner through the top feed roll smoothly into the lower formation section chute. The invention is particularly to use with one to four-meter wide carding machines.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a side elevation illustrating an apparatus for uniformly supplying fiber flock to a chute feed, in accordance with the present invention, and then to a carding machine;

FIG. 2 is a perspective view of a portion of a reserve section of a chute feed with the vane constructed in accordance with the present invention;

DESCRIPTION OF A PREFERRED EMBODIMENT

Figure 3:
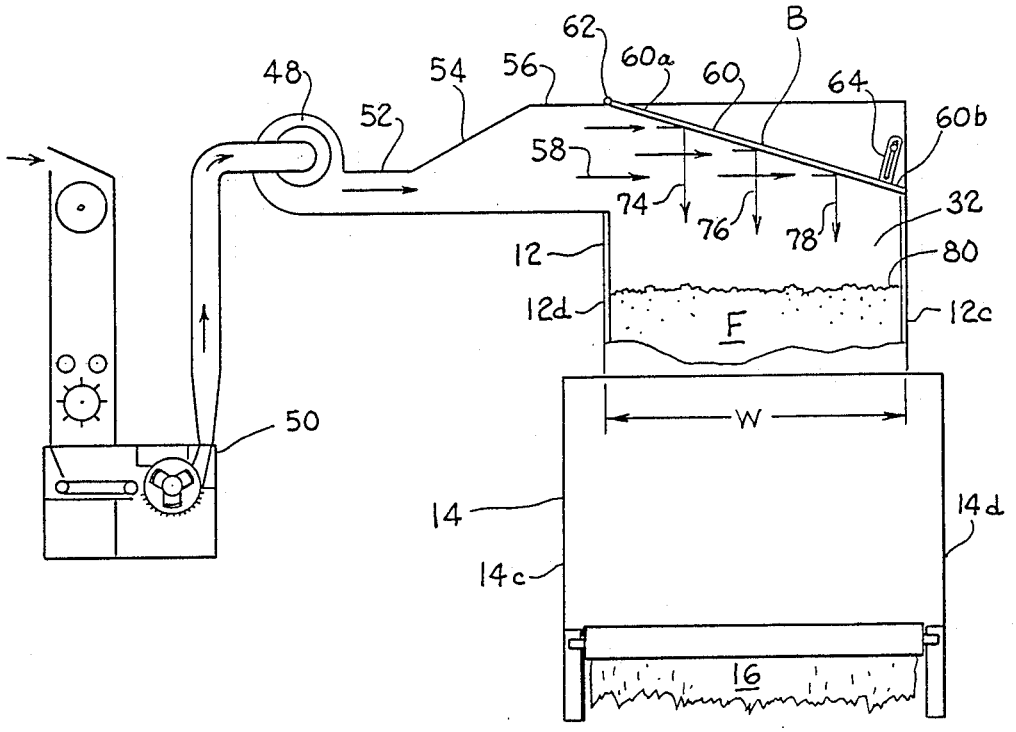
FIG. 3 is an elevation, partially diagramatic, illustrating apparatus and method for uniformly supplying fiber flock to a chute feed in accordance with the present invention.

Referring now in more detail to the drawings, a chute feed, designated generally as 10, includes an upper reserve section 12 and a lower formation section 14, as can best be seen in FIG. 1. As illustrated in FIG. 3, the chute feed feeds fiber F to a carding machine in the form of a batt 16. The carding machine typically includes a carding cylinder 20 and a licker end roll 22 which feeds the fiber batt 16 to the carding cylinder 20. The carding cylinder cleans and straightens the fibers, arranging them in parallel. The fibers are taken from the carding cylinder by a doffing cylinder 24. The fibers are then condensed in a trumpet 26 and drawn off in the form of a sliver 28 between a pair of draw-off rolls 30. The sliver is then carried for further processing in the manufacture of yarn, fabric, etc.

Referring now in more detail to the apparatus and method of the present invention, the reserve section 12 as can best be seen in FIG. 2, is illustrated as including a front wall **12*a*, a back wall 12*b*, and integral end walls 12*c* and 12*d* which define an enclosed vertical chute 32 through which fibers F are supplied. A top feed roll 34 is carried at the bottom of the chute 32 of the reserve section 12 and there is a feed plate 36. A nip 38 is defined between the feed plate and the feed roll between which sliver is fed to an opening roller 39 which further opens the fibers. The feed roll 34 and opening roll 39 extend axially across the width of chute 32**.

There is a second vertical chute 40 extending below the opening roller defined by a front wall **40*a*, back wall 40*b*, and end walls 14*c*, 14*d* of the formation chamber 14. Backwall 40*b* includes a portion that is perforated at 40*c* for the exit of air. A pair of bottom feed rolls 41 and 42 are carried adjacent the bottom of the formation chamber. A further portion of wall 40*b* includes an oscillating densification plate 43 commonly referred to as a spanker plate or breather plate. The densification plate 43 hinged to 40*c* oscillates back and forth to compress the fibers F in the formation section so that a proper fiber density and volume (weight) is included in the fiber batt 16 fed between the delivery rolls. Typically, the speed of the oscillation of the breather plate 43 and the delivery rolls 41 and 42 are controlled in response to the weight of the sliver as may be detected by a detector 44**. More detail of the formation section can be had by reference to the aforesaid U.S. Pat. No. 4,476,611.

An entrance in the form of an opening 46 is located in an upper part of the reserve section 12 which is connected by suitable duct means A to a transport blower 48 and a conventional fiber opening system 50. Fibers are removed, for example from a cotton bale, and delivered to the fiber opening system wherein the fibers are opened so that the trash and other dirt may be removed. The fibers are convey by air from the opening system to the transport blower 48 whereupon the fiber-laden air is delivered into the duct means to the entrance 46 of the reserve section.

The duct means A is illustrated in the form of an intermediary connecting duct 52, a divergent airflow expansion nozzle duct 54, and a straight duct section 56 connected directly to the entrance end 46 of the reserve section. The fiber-laden air is directed through the duct means to the reserve section at 58 in a generally horizontal flow. The divergent expansion nozzle 54 causes the fiber-laden air to expand and slow prior to delivering to the entrance of the reserve section.

As can best be seen in FIGS. 1 and 2, airflow deflection means B is shown in the form of a pivotable airflow control vane 60 which extends across the entire width W of the chute 32 of the reserve section and is pivotably attached at the entrance 46. The vane B is disposed at an inclination to the horizontal incoming airflow 58. The vane B is illustrated as an elongated rectangular plate having one end **60*a* pivoted at 62 adjacent the top of the entrance 46. A piano-type hinge 64 or other suitable means for pivoting the vane may be utilized. The opposing end 60*b* of the vane extends to adjacent the remote side 12*c* of the reserve section. The vane 60 extends from one side of the chute 32 to the other and has width generally equal to depth D, to form an upper inclined enclosure which deflects and restricts the incoming air across the entire width of the chute. The impingement surface of vane 60** coextends with the chute cross-section to deflect all the air.

Vane position means for adjusting the inclination of the vane may be provided so that the vane pivots at varying degrees of inclination from the entrance end downwardly to an opposing end **60*b* at the side 12*c* of the reserve section. As illustrated, the adjusting means includes a slotted leg 64 having an adjustment slot 64*a* formed therein, a threaded post 66 fixed in the wall 12*b* of the reserve section extends through the slot and a threaded fastener 67 may be loosened so the leg may slide relative to the slot and be adjusted. The inclination of the air control vane B may be adjusted as desired and the threaded post tightened to hold the vane in place. Depending on the conditions of the entering fiber-laden airflow, the vane can be adjusted as desired to deposit the fiber flock to have a level surface. In some applications, a non-level surface may be desired and the vane inclination may be so adjusted. Numerous Plexiglass inserts 68 are provided in the front wall 12*a*** for viewing of the inside of the chute.

In accordance with the apparatus and method of the invention, the fiber-laden air is expanded through the divergent nozzle 54 and is slowed through intermediate conduit 56 in a generally horizontal flow. The slowed airflow enters the entrance 46 of the reserve section whereupon the air and fiber flock carried by the air impinge upon the inclined airflow control vane B. The turbulence is reduced in the chute by the initial airflow conditions and most importantly the flow-stabilizing effect of the control vane whereby stable vertical flow patterns are produced. Fiber-laden air impinges upon the vane and deflects form a general horizontal direction to a vertical direction. The fiber flock falls and is deposited directly below in the reserve section chute A. Transport air leaves the reserve chute through vertical passages formed in a slotted grille 70 extending across the back wall **12*b* as shown by arrows 72. The grille 70 is carried well above the column of fibers deposited at F and provides air passage means for the exit of transport air. The grille 70 is upstream of the formation zone of the fiber block F and above approximately midway of the reserve section. Initially the fiber-laden air flowing generally horizontally at 58 is deflected at 74** in a generally vertical direction.

Figure 4:
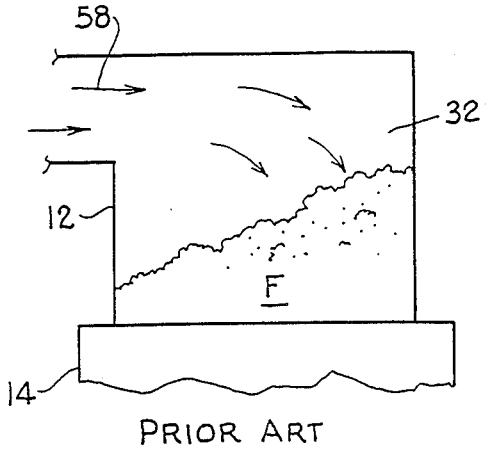
FIG. 4 is a front elevation of a reserve section of a chute feed supplying fiber in accordance with the prior art.

Fiber-laden airflow traveling generally midway across the chute strikes the vane and is redirected in a vertical direction generally at 76 to be deposited in the reserve section chute. At the outermost extent of the inclined vane, the horizontal flow of fiber-laden air impinges upon the vane and is directed generally at 78 to a vertical flow whereupon it is deposited vertically into the reserve section. The inclination of the vane can be adjusted to the flow to provide a level disposition of fibers. In this manner, there is achieved a level and uniform distribution of the fibers in a column across the entire width of the reserve section chute 32, as can best be seen in FIG. 3. In contrast to the supply of fibers in the prior art (FIG. 4), wherein the airflow carries most of the fiber to the far side 12*c* of the reserve section with a decreasing buildup toward the entrance 46 and side 12*d*. The distribution of fiber flock in accordance with the present invention can be made generally level across the width of the chute. The generally level distribution of a top surface 80 of the fiber flock results in a uniform air pressure being exerted on the columnized fiber flock F. Fiber flock is fed to the top feed roll 34 at an even weight across the entire axial length of the feed roll. The expansion entrance conduit A slows the airflow so that the pattern deflected by the inclined air control vane B is reduced in turbulence whereby fibers so that a more nearly level surface 80 is achieved across the column of deposited fibers.

Pressure exerted on top of the column of fibers in the chute 32 of the reserve section 12 is generally constant across the column. Feeding of the column of fibers F is accomplished at a uniform weight across the entire width of the chute and feed roll axis whereby uniform opening of the fibers is achieved by opening roller 39.

In this manner, a uniform condition of openness 39 occurs whereby the fibers accumulated in accumulation chamber 40 are more uniformly individualized and open. The fibers are accumulated in a level manner across the width of chute 40 and are compressed uniform from one side of the chute to another. The oscillation of densification plate 43 then produces a fiber batt having less density variations across the width of the batt 16.

While a preferred embodiment of the invention has been described using specific terms, such description is for illustrative purposes only, and it is to be understood that changes and variations may be made without departing from the spirit or scope of the following claims.

What is claimed is:

1. Apparatus for supplying fibers to a chute feed of the type which includes a top reserve section having a first vertical chute defined by front and back walls, and integral first and second sides with an entrance formed in said first side through which fibers enter and descend through said first chute after entering said entrance, and a lower formation section having a second vertical chute through which fibers descend; a top feed roll carried at the top of said second chute and below said first chute extending axially across a width of said first chute defined between said first and second sides; an opening roller carried in said second chute extending axially along and parallel to said feed roll to open said fibers received from said top feed roll; a pair of delivery rollers carried adjacent an outlet of said second chute for delivering fibers outwardly from said chute feed; means for compressing said fibers prior to being delivered by said delivery rollers; wherein said apparatus further comprises duct means for delivering a flow of fiber-laden air which includes said fibers and air to said entrance of said reserve section; an imperforate airflow control deflection means carried within said reserve section extending axially in the direction of said top feed roll generally being inclined from said entrance at said first side to a lowermost end at said second side of said reserve section for (a) deflecting said flow of fiber-laden air from a generally horizontal direction to distribute the fibers to the surface of a column thereof within said first chute having a generally level surface for (b) equalizing the pressure exerted by said air and said fibers on said column of fibers and thus for (c) a uniform feeding of fibers by said top feed roll into said second chute.

2. The apparatus of claim 1 wherein said airflow control deflection means includes an elongate pivotal air deflection means pivotally carried within said chute of said reserve section having a front end pivotally attached to said entrance of said reserve section, and a remote end extending across said first chute adjacent to and terminating said second side of said reserve section; and said elongate deflection means having an imperforate deflection surface area generally coextensive with the cross-section area of said first chute whereby substantially the entire flow of said incoming fiber-laden air impinges upon said deflection means; and said deflection means being inclined to said flow for uniformly deflecting said incoming airflow downwardly into said first chute to deposit said fibers in a uniform compacted column fiber block having a generally uniformly level fiber surface.

3. The apparatus of claim 2 including means for adjusting the degree of inclination of said pivotal airflow deflection means with respect to the incoming flow of fiber-laden air.

4. The apparatus of claim 2 wherein said pivotal air deflection means includes an elongate vane member pivoted at said first side near said entrance of said reserve section with its remote end extending adjacent to said second side of said reserve section chute, said member having a width sufficient to act as a top to and to close the upper portion of said chute at its adjustable angles of inclination.

5. The apparatus of claim 4 including vane member positioning means for adjusting and fixing thereat the inclination and position of said elongated vane in said reserve section chute.

6. The apparatus of claim 2 wherein said duct means includes a first divergent nozzle section to expand and slow said incoming flow of fiber-laden air; and a duct section connected between said divergent nozzle section and said entrance of said reserve section of sufficient size and contour to reduce turbulence in said incoming airflow.

7. The apparatus of claim 1 including air exit means, disposed below said lowermost end of said airflow control deflection means and above the flat, level surface of said fiber column for removing transport air.

8. Apparatus for supplying and distributing fiber in a chute feed of the type having a vertical chute defined by front and back walls and integral opposing sides in which fiber entrained in a fiber-laden airflow is delivered from a fiber supply source through a side entrance formed in said chute feed at one side thereof; and a fiber batt is fed from said chute to an associated machine in a direction perpendicular to the delivery of fiber through said side entrance, wherein the improvement comprises an elongate means for airflow control deflection having one end pivotally attached adjacent a top portion of said side entrance and extending away from said side entrance towards a second end terminating closely adjacent a second and opposing side of said chute; said airflow control deflection means also having imperforate surface means generally corresponding and coextensive with a cross section of said chute for (i) generally enclosing an upper portion of said chute, for (ii) deflecting generally all of said fiber-laden airflow from a generally horizontal flow to a generally vertical flow, and for (iii) forming within said chute a column of fibers having a substantially level or flat upper surface.

9. The apparatus of claim 8 including means for adjustably positioning the airflow deflection means within said chute.

10. The apparatus of claim 8 including divergent conduit means for expanding and slowing said incoming flow of fiber-laden air flow prior to impinging upon said airflow control surface.

11. The apparatus of claim 8 wherein said pivotal air deflection means includes an elongate vane pivoted at one end adjacent said entrance of said chute and a remote end extending adjacent so said opposing side of said chute, said vane having a width generally equal to a depth of said chute to generally enclose an upper portion of said chute at varying angles of inclination.

12. The apparatus of claim 8 including air exit means disposed below said entrance and above said level surface of said column of said fiber for removal of transport air.

13. A method for supplying fibers to a chute feed having an upper reserve section with a vertical chute having a front wall, back wall, first and second opposing sides, and upper side entrance formed in said first side, a lower formation section with a vertical chute, and a fiber feed roll extending axially between said first and second sides between said reserve and formation chutes parallel to said front and back walls, said method comprising the steps:

delivering a generally horizontal flow of fiber-laden air which includes said fibers and air to said side entrance of said reserve section;

arranging an imperforate airflow control vane surface coextending across the cross section of said vertical chute of said reserve section at a prescribed inclination from said first side to said second side;

directing said horizontal flow of fiber-laden air against said airflow control vane surface to deflect and constrict said horizontal flow from said first side to said second side across said reserve section chute from said horizontal flow to a generally vertical direction in a manner in which turbulence is reduced and a level distribution of said fibers is deposited in said chute to form a flat surface column of fibers.

14. The method of claim 13 including slowing the velocity of said fiber-laden airflow prior to impinging upon said vane surface.

15. The method of claim 13 including pivoting said airflow control vane surface adjacent said side entrance of said reserve section and adjusting the inclination of said vane across said chute to prescribe a level for flat distribution of fibers in said reserve section chute.

* * * * *